US008852299B2

(12) United States Patent
Aradi

(10) Patent No.: US 8,852,299 B2
(45) Date of Patent: Oct. 7, 2014

(54) FUEL COMPOSITION

(75) Inventor: Allen A. Aradi, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 788 days.

(21) Appl. No.: 11/427,843

(22) Filed: Jun. 30, 2006

(65) Prior Publication Data

US 2008/0000149 A1 Jan. 3, 2008

(51) Int. Cl.

| | |
|---|---|
| ***C10L 1/18*** | (2006.01) |
| ***C10L 1/12*** | (2006.01) |
| ***C10L 1/30*** | (2006.01) |
| ***C10L 10/10*** | (2006.01) |
| ***C10L 1/00*** | (2006.01) |

(52) U.S. Cl.

CPC ..... *C10L 1/305* (2013.01); *C10L 1/1241* (2013.01); *C10L 10/10* (2013.01); *C10L 1/00* (2013.01)

USPC ..... 44/359; 44/354; 44/358

(58) Field of Classification Search

USPC ..... 60/274, 301; 44/359, 449, 360, 412, 44/358, 354

See application file for complete search history.

(56) References Cited

U.S. PATENT DOCUMENTS

| | | | | |
|---|---|---|---|---|
| 2,818,417 | A | 12/1957 | Brown et al. | |
| 4,568,357 | A | 2/1986 | Simon | |
| 4,674,447 | A | 6/1987 | Davis | |
| 5,113,803 | A | 5/1992 | Hollrah et al. | |
| 5,599,357 | A | 2/1997 | Leeper | |
| 5,679,116 | A * | 10/1997 | Cunningham et al. | 44/359 |
| 5,944,858 | A | 8/1999 | Wallace | |
| 6,238,446 | B1 * | 5/2001 | Henderson | 44/359 |
| 2002/0112466 | A1 * | 8/2002 | Roos et al. | 60/274 |

FOREIGN PATENT DOCUMENTS

| | | |
|---|---|---|
| CN | 1195367 | 10/1998 |
| EP | 0 359 390 | 3/1990 |
| EP | 466512 B1 | 1/1992 |
| GB | 851 587 | 10/1960 |
| GB | 901 689 | 7/1962 |

OTHER PUBLICATIONS

Strem, Michael E., Annals of the New York Academy of Sciences, 145 (1) (1967) pp. 123-140.

Marshall et al., Annals of the New York Academy of Sciences, 125 (1) (1965) pp. 198-217.

* cited by examiner

*Primary Examiner* — Prem C Singh
*Assistant Examiner* — Latosha Hines
(74) *Attorney, Agent, or Firm* — MH2 Technology Law Group LLP

(57) ABSTRACT

There is disclosed a method for combusting a secondary organometallic compound in an engine including (a) combining a secondary organometallic compound and methylcyclopentadienyl manganese tricarbonyl, (b) introducing the combination from (a) into a fuel, and (c) causing the fuel from (b) to be combusted in the engine.

14 Claims, 5 Drawing Sheets

FUEL COMPOSITION

DESCRIPTION OF THE DISCLOSURE

1. Field of the Disclosure

The present disclosure relates to fuel compositions comprising organometallic compounds and methylcyclopentadienyl manganese tricarbonyl compounds. These compounds can be blended at synergistic ratios that optimize octane performance of a fuel. The synergistic ratios can be determined by measuring the pre-eutectic transition point temperature.

2. Background of the Disclosure

A need exists to deliver combustion improvers to fuels in an efficient and cost effective manner. Combustion improvers can vary widely in cost, physical properties, handling and safety requirements, quality or purity, and efficacy. Thus, for certain applications, customers of combustion improvers desire to improve, that is, reduce their costs and, if possible, decrease the amount of combustion improvers.

Fuels and fuel blends that utilize combustion improvers have included diesel fuel, gasoline, biodiesel, coal and other hydrocarbonaceous materials. The combustion improvers have included a variety of accelerants, ignition improvers, octane improver, cetane improvers, smoke reducers, slag reducers, oxidation catalysts, catalytic converter protectors, and the like.

There is a desire to improve performance of the internal combustion engine by incorporation of blends of fuels and/or blends of combustion improvers.

SUMMARY OF THE DISCLOSURE

In accordance with the disclosure, there is disclosed a method for combusting a secondary organometallic compound in an engine comprising; (a) combining a secondary organometallic compound and methylcyclopentadienyl manganese tricarbonyl, (b) introducing the combination from (a) into a fuel, and (c) causing the fuel from (b) to be combusted in the engine.

In an aspect, there is disclosed a method for enhancing octane number of gasoline comprising (a) combining cyclopentadienyl manganese tricarbonyl and methylcyclopentadienyl manganese tricarbonyl, and (b) adding said combination to the gasoline.

There is also disclosed a method of optimizing octane performance in a fuel composition comprising measuring a pre-eutectic transition point temperature of a synergistic blend comprising methylcyclopentadienyl manganese tricarbonyl and an organometallic compound.

In a further aspect, there is disclosed a eutectic mixture comprising methylcyclopentadienyl manganese tricarbonyl and an organometallic compound.

Further, there is disclosed a blend of combustion improvers useful for optimizing octane response of a fuel comprising mixtures of two or more materials selected from the group consisting of organometallic cyclomatic manganese tricarbonyls, MMT/CMT, MMT/R—$Mn(CO)_5$ where R is an aryl- or alkyl-radical species, mixed metal organometallics of Mn/Fe, Mn/Ce, Mn/Pt, Mn/Platinum-group metals, Mn/Cu, Fe/Ce, Fe/Platinum-group metals, Fe/Cu, Mn/Pb, Fe/Pb, Ce/Pb, and Pb/Platinum-group metals, where the optimum ratios of compounds in these mixtures are below that of any of the individual component in the mixture.

Additional objects and advantages of the disclosure will be set forth in part in the description which follows, and/or can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate one (several) embodiment(s) of the disclosure and together with the description, serve to explain the principles of the disclosure.

DESCRIPTION OF THE EMBODIMENTS

Figure 1:
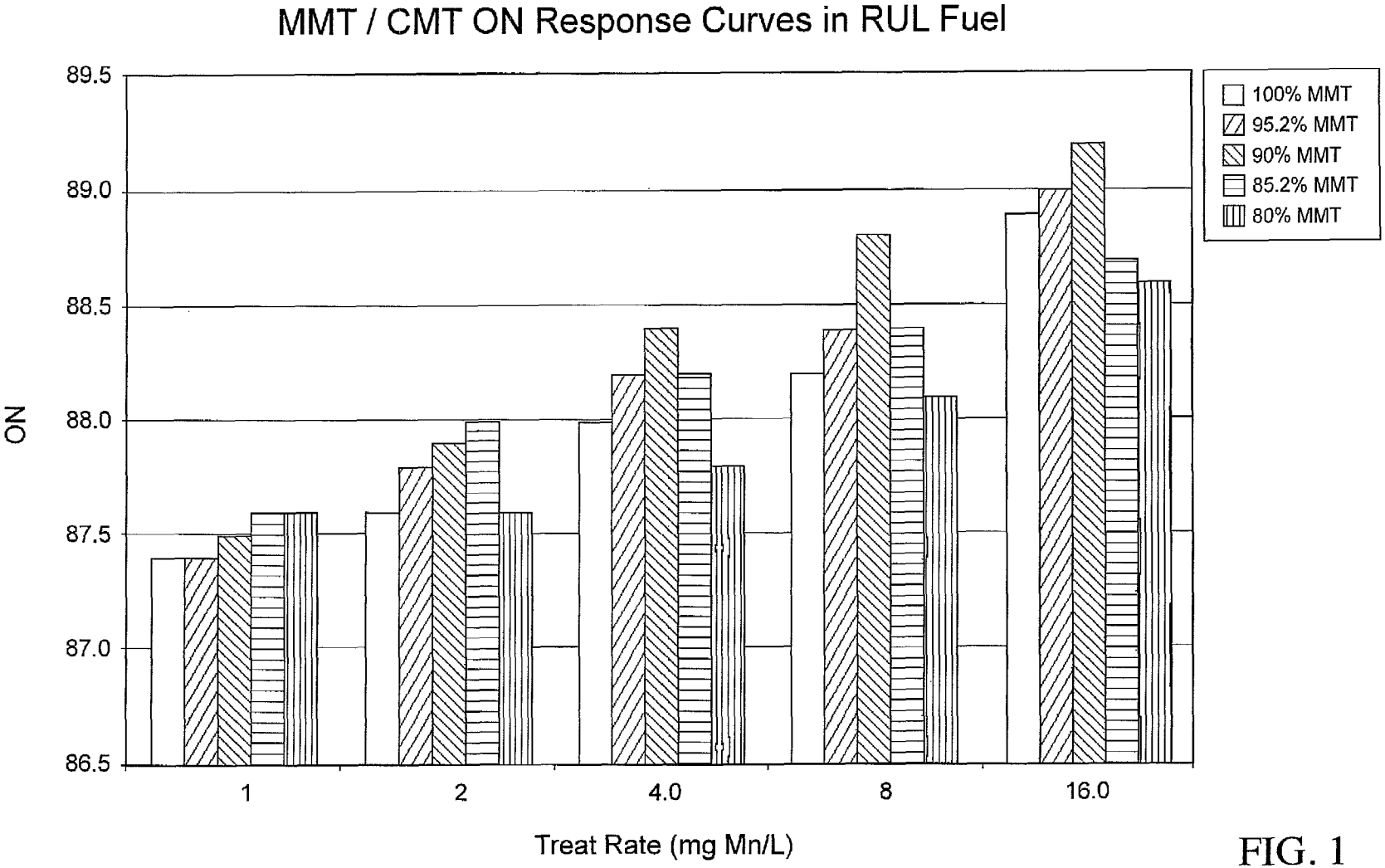
FIG. 1 is a graph illustrating oxidation number response curves on compositions comprising various blends of methylcyclopentadienyl manganese tricarbonyl and cyclopentadienyl manganese tricarbonyl.

The present disclosure is directed to fuel compositions comprising from about 0.5 to about 20% by weight of a secondary organometallic compound relative to the total weight of a primary organometallic compound, wherein the secondary organometallic compound is not methyl cyclopentadienyl manganese tricarbonyl (MMT). In an aspect, the secondary organometallic compound can be an organometallic, manganese-containing compound, such as cyclopentadienyl manganese tricarbonyl (CMT). The fuel composition can also comprise MMT. It has been found that fuel compositions comprising MMT and a secondary organometallic compound, wherein the secondary organometallic compound is not MMT, exhibit several types of unexpected synergy.

A "primary" organometallic compound is the main additive compound and a "secondary" organometallic compound is the additional organometallic component providing the enhanced performance of the additive.

There is also disclosed a method for combusting a secondary organometallic compound in an engine comprising; (a) combining a secondary organometallic compound and methylcyclopentadienyl manganese tricarbonyl, (b) introducing the combination from (a) into a fuel, and (c) causing the fuel from (b) to be combusted in the engine. The term "causing" as used herein is understood to include the expectation, knowledge or intent to thereby facilitate the eventual combustion of the fuel containing both the organometallic (such as CMT) and the MMT.

The fuel compositions disclosed herein can comprise a secondary organometallic compound at a treat rate ranging from about 1 to about 40 mg metal/liter of fuel, whereas from about 1 to about 20 wt % of the metal is CMT and others.

Where MMT is the primary organometallic component, and CMT the secondary, the combined MMT/CMT can be present in the disclosed fuel compositions at a treat rate of about 1 to about 16 mg Mn/liter of fuel, for example from about 2 to about 20 mg MN/liter of fuel, and as a further example from about 4 to about 8 mg Mn/liter of fuel. In an aspect, the MMT is present at a treat rate of 8 mg Mn/liter of fuel. In particular, an increase of about 50% in octane number can be achieved at a treat rate of 8 mg Mn/liter of fuel of MMT as compared to the use of MMT alone. One of ordinary skill in the art would readily be able to determine the treat rates of other primary organometallic compounds and secondary organometallic compounds by measuring the pre-eutectic transition temperature as discussed below.

In an aspect, the fuel compositions can comprise a blend of MMT and an organometallic compound, wherein the organometallic compound is not MMT. The blends can be in a ratio of about 95 MMT:5 organometallic compound by weight or by volume, for example about 90:10, as a further example about 85:15, including about 80:20, and as a further example about 75:25. In an aspect, the blend ratio can be 90 MMT:10 CMT.

In an aspect, MMT has been found to be an excellent solvent for CMT. Thus, the blends of the present disclosure can be neat.

It is believed, without being limited to any particular theory, that blends for use in the present fuel composition can include binary mixtures of organometallic cyclomatic manganese tricarbonyls, MMT/CMT, MMT/R—$Mn(CO)_5$ where R can be aryl- or alkyl-radical species; mixed metal organometallics where the mixed metal components are selected from Mn/Fe, Mn/Ce, Mn/Pt, Mn/Platinum-group metals, Mn/Cu, Fe/Ce, Fe/Platinum-group metals, Fe/Cu, Mn/Pb, Fe/Pb, Ce/Pb, Pb/Platinum-group metals, etc, and ternary and higher order of mixed metal combinations. The pre-eutectic transition point temperature of the optimum ratios of compounds in these mixtures is below the freezing point temperature of the primary organometallic compound in the mixture.

In an aspect, there is disclosed a method of optimizing synergism in a fuel composition comprising measuring a pre-eutectic transition point temperature of a blend comprising MMT and a secondary organometallic compound. The pre-eutectic transition point temperature has been shown to correlate with enhanced octane performance.

The term "optimizing" as used herein has its ordinary meaning and is understood as making the synergism of the fuel composition as effective a possible.

The term "enhanced" as used herein means an improvement in the octane performance of a fuel composition relative to a similar fuel composition that does not have a synergistic eutectic mixture.

The blend can be a eutectic mixture. The term "eutectic mixture" is given its ordinary meaning and should be understood to mean a mixture of two or more phases at a composition that has the lowest melting point, and wherein the phases simultaneously crystallize from molten solution at this temperature.

The organometallic compound, both primary and secondary, for use in the disclosed fuel composition can include any compound comprising an organo group and at least one metal atom, such as a manganese atom. Exemplary organo groups include, but are not limited to, alcohols, aldehydes, ketones, esters, anhydrides, sulfonates, phosphonates, chelates, phenates, crown ethers, naphthenates, carboxylic acids, amides, acetyl acetonates, and mixtures thereof. Manganese-containing organometallic compounds can include, for example, manganese tricarbonyl compounds. Such compounds are taught, for example, in U.S. Pat. Nos. 4,568,357; 4,674,447; 5,113,803; 5,599,357; 5,944,858 and European Patent No. 466 512 B1, the disclosures of which are hereby incorporated in their entirety.

Suitable manganese tricarbonyl compounds which can be used include, but are not limited to, cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. One example is the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc.

Preparation of Such Compounds is Described in the Literature, for example, U.S. Pat. No. 2,818,417, the disclosure of which is incorporated herein in its entirety.

Non-limiting examples of manganese-containing compounds include non-volatile, low cluster size (1-3 metal atoms) manganese-containing compounds such as bis-cyclopentadienyl manganese, bis-methyl cyclopentadienyl manganese, manganese naphthenate, manganese II citrate, etc, that are either water or organic soluble. Further examples include, but are not limited to, non-volatile, low cluster manganese-containing compounds embedded in polymeric and/or oligomeric organic matrices such as those found in the heavy residue from the column distillation of crude MMT.

The disclosed fuel composition can comprise a hydrocarbonaceous fuel. By "hydrocarbonaceous fuel" herein is meant hydrocarbonaceous fuels such as, but not limited to, diesel fuel, jet fuel, alcohols, ethers, kerosene, low sulfur fuels, synthetic fuels, such as Fischer-Tropsch fuels, biomass to liquids (BTL) fuels, coal to liquids (CTL) fuels, gas to liquids (GTL) fuels, liquid petroleum gas, fuels derived from coal, genetically engineered biofuels and crops and extracts therefrom, natural gas, propane, butane, unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds, fuels with mixtures of different volatility oxygenates to modulate the volatility of the bulk fuel. Oxygenates suitable for use in the fuels of the present disclosure include methanol, ethanol, isopropanol, t-butanol, mixed alcohols, methyl tertiary butyl ether, tertiary amyl methyl ether, ethyl tertiary butyl ether and mixed ethers. Oxygenates, when used, will normally be present in the reformulated gasoline fuel in an amount below about 25% by volume, and for example in an amount that provides an oxygen content in the overall fuel in the range of about 0.5 to about 5 percent by volume. "Hydrocarbonaceous fuel" or "fuel" herein shall also mean waste or used engine or motor oils which may or may not contain molybdenum, gasoline, bunker fuel oil, marine fuel oil, utility and industrial boiler, furnace and burner fuel oils, coal (dust or slurry), crude oil, refinery "bottoms" and by-products, crude oil extracts, hazardous wastes, yard trimmings and waste, wood chips and saw dust, agricultural waste, fodder, silage, plastics and other organic waste and/or by-products, and mixtures thereof, and emulsions, suspensions, and dispersions thereof in water, alcohol, or other carrier fluids. By "diesel fuel" herein is meant one or more fuels selected from the group consisting of diesel fuel, biodiesel, biodiesel-derived fuel, synthetic diesel and mixtures thereof. In an aspect, the hydrocarbonaceous fuel is substantially sulfur-free, by which is meant a sulfur content not to exceed on average about 30 ppm of the fuel.

The disclosed fuel compositions can be combusted in an engine, such as a spark ignition engine or compression ignition engine, for example, advanced spark ignition and compression ignition engines with and without catalyzed exhaust after treatment systems with on-board diagnostic ("OBD") monitoring. To improve performance, fuel economy and emissions, advanced spark ignition engines may be equipped with the following: direct injection gasoline (DIG), variable valve timing (VVT), external exhaust gas recirculation (EGR), internal EGR, turbocharging, variably geometry turbocharging, supercharging, turbocharging/supercharging, multi-hole injectors, cylinder deactivation, and high compression ratio. The DIG engines may have any of the above including spray-, wall-, and spray/wall-guided in-cylinder fuel/air charge aerodynamics. More advanced DIG engines in the pipeline will be of a high compression ratio turbocharged and/or supercharged and with piezo-injectors capable of precise multi-pulsing of the fuel into the cylinder during an injection event. Exhaust after treatment improvements will include a regeneratable $NO_x$ trap with appropriate operation electronics and/or a NOx catalyst. The advanced DIG engines described above will be use in gasoline-electric hybrid platforms.

For compression ignition engines, there will be advanced emissions after treatment such as oxidation catalyst, particulate trap (PT), catalyzed PT, $NO_x$ trap, on-board $NO_x$ additive (i.e. urea) dosing into the exhaust to remove $NO_x$, and plasma reactors to remove NOx. On the fuel delivery side common rail with piezo-activated injectors with injection rate-shaping software can be used. Ultra-high pressure fuel injection (from 1800 Bar all the way to 2,500 Bar), EGR, variable geometry turbocharging, gasoline homogeneous charge compression ignition (HCCl) and diesel HCCl. Gasoline- and diesel-HCCl in electric hybrid vehicle platforms can also be used.

The term "after treatment system" is used throughout this application to mean any system, device, method, or combination thereof that acts on the exhaust stream or emissions resulting from the combustion of a diesel fuel. "After treatment systems" include all types of diesel particulate filters—catalyzed and uncatalyzed, lean $NO_x$ traps and catalysts, select catalyst reduction systems, $SO_x$ traps, diesel oxidation catalysts, mufflers, $NO_x$ sensors, oxygen sensors, temperature sensors, backpressure sensors, soot or particulate sensors, state of the exhaust monitors and sensors, and any other types of related systems and methods.

In an aspect, the organometallic compound and the MMT can be combined and introduced into a fuel, and causing the fuel to be combusted in an engine.

The disclosed blend can also be combusted in other systems, such as those of atmospheric combustion used in utility and industrial burners, boilers, furnaces, and incinerators. These systems can burn from natural gas to liquid fuels (#5 fuel oil and heavier), to solid fuels (coals, wood chips, burnable solid wastes, etc).

In another aspect, there is disclosed a method for solubilizing cyclopentadienyl manganese tricarbonyl in a hydrocarbonaceous fuel, by combining in any order cyclopentadienyl manganese tricarbonyl, methyl cyclopentadienyl manganese tricarbonyl, and a hydrocarbonaceous fuel. Thus, the CMT can be dissolved, dispersed, melted or otherwise mixed into or combined with the MMT under conditions of time, temperature and pressure sufficient to solubilize the solid CMT in the liquid MMT. In another aspect, the MMT can be added to the CMT to achieve similar solubilization of the CMT. In yet another aspect of the present disclosure, the CMT and MMT can be added simultaneously or sequentially to the hydrocarbonaceous fuel, such as diesel or gasoline fuel, for example, under conditions sufficient to achieve the desired solubilization. For maximum benefit, blend of primary and secondary organometallic compounds can be blended first then added to the fuel.

A further aspect of the present disclosure is the presence or occurrence, whether inadvertent or not, of CMT resulting in or from the production of MMT. Such presence might occur as a result of impurities (cyclopentadiene dimer or monomer) in the raw material methylcyclopentadiene used to make MMT, and some of this impurity can then associate with a manganese atom with subsequent carbonylation to form CMT. As an example, there can be by this process easily an amount of 1.5% by weight CMT in the MMT. The resulting mix of MMT and CMT has the CMT solubilized in the MMT, whereby the CMT can be readily mixed with a fuel.

One benefit of this embodiment is a potential cost reduction by utilizing as much of the lower cost CMT as desired in a fuel additized with MMT. No detrimental effect on the fuel or its combustion is noted, nor is the engine adversely affected.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as formation of the organometallic compound) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations or immediately thereafter is thus wholly immaterial for an accurate understanding and appreciation of this disclosure and the claims thereof.

EXAMPLES

Figure 2:
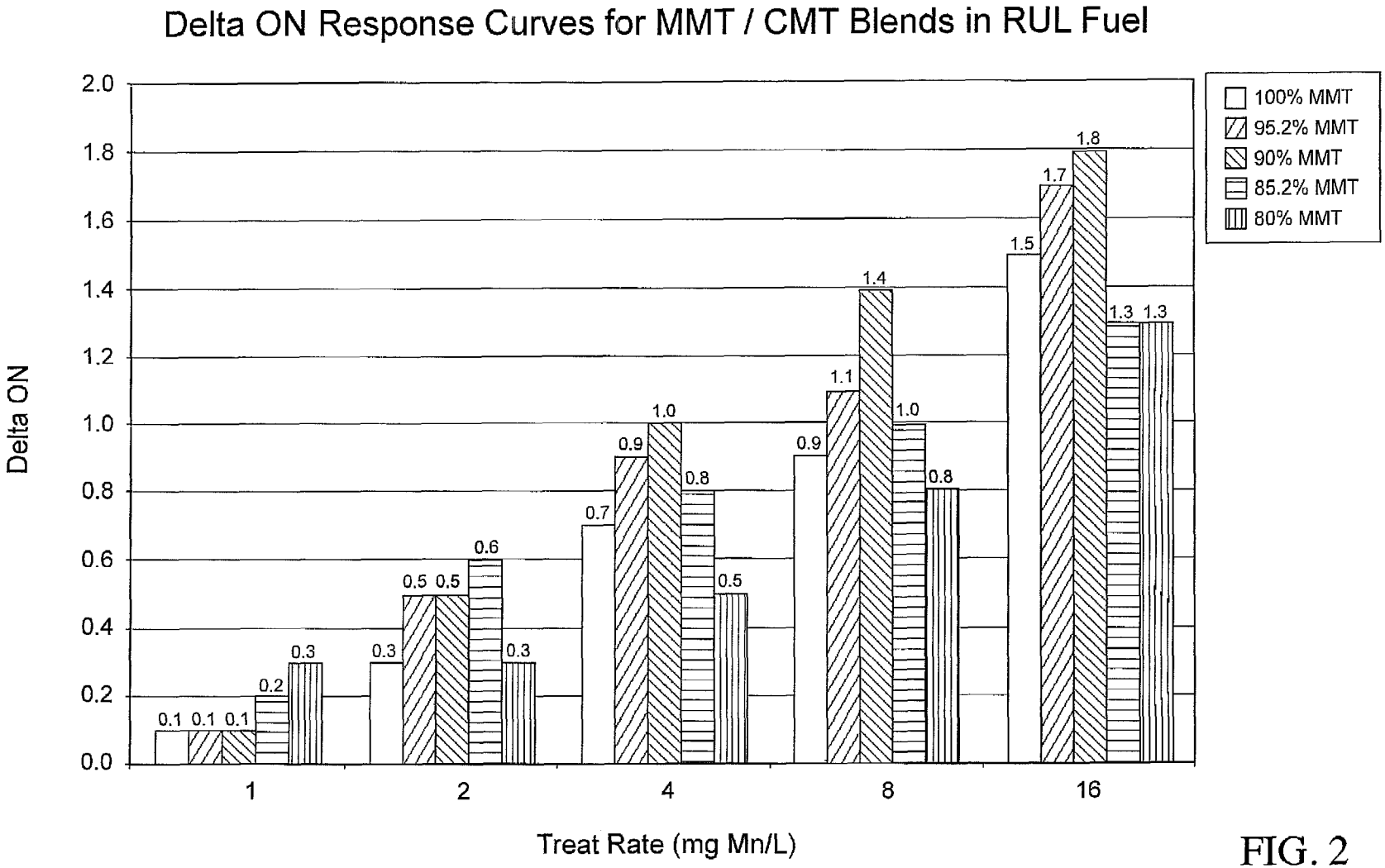
FIG. 2 is a graph illustrating the change in oxidation number response curves on compositions comprising various blends of methylcyclopentadienyl manganese tricarbonyl and cyclopentadienyl manganese tricarbonyl.

Octane responses of the various gasoline blends were determined on the ASTM-CFR test engine. The research octane number (RON) of each fuel was determined using the ASTM D2699 method and the motor octane number MON) by the ASTM D2700 method. At each manganese treat rate shown in FIGS. 1-4 the fuel blends were bracketed by the unadditized base fuel. Fuel compositions containing MMT/CMT blends of about 0.5 to about 20% by weight CMT in MMT were tested for octane response in regular unleaded gasoline (RUL), at equal manganese levels. FIGS. 1 and 2 summarize the resultant octane changes. FIG. 1 shows the improvement in octane number by the different MMT/CMT blends at each manganese (mg Mn/L) treat rate. FIG. 2 isolates that octane change from that of the base fuel. A surprising octane synergism was found with the blend comprising about 10% CMT in 90% MMT in fuels treated at the normal treat rate of 8 mg Mn/L fuel. In particular, this blend gave an octane number change of 1.4 relative to 0.9 for MMT alone. This is a 56% enhancement of octane response over that of MMT alone at 8 mg Mn/L. This octane response synergism was also evident at 4 and 16 mg Mn/L.

Figure 3:
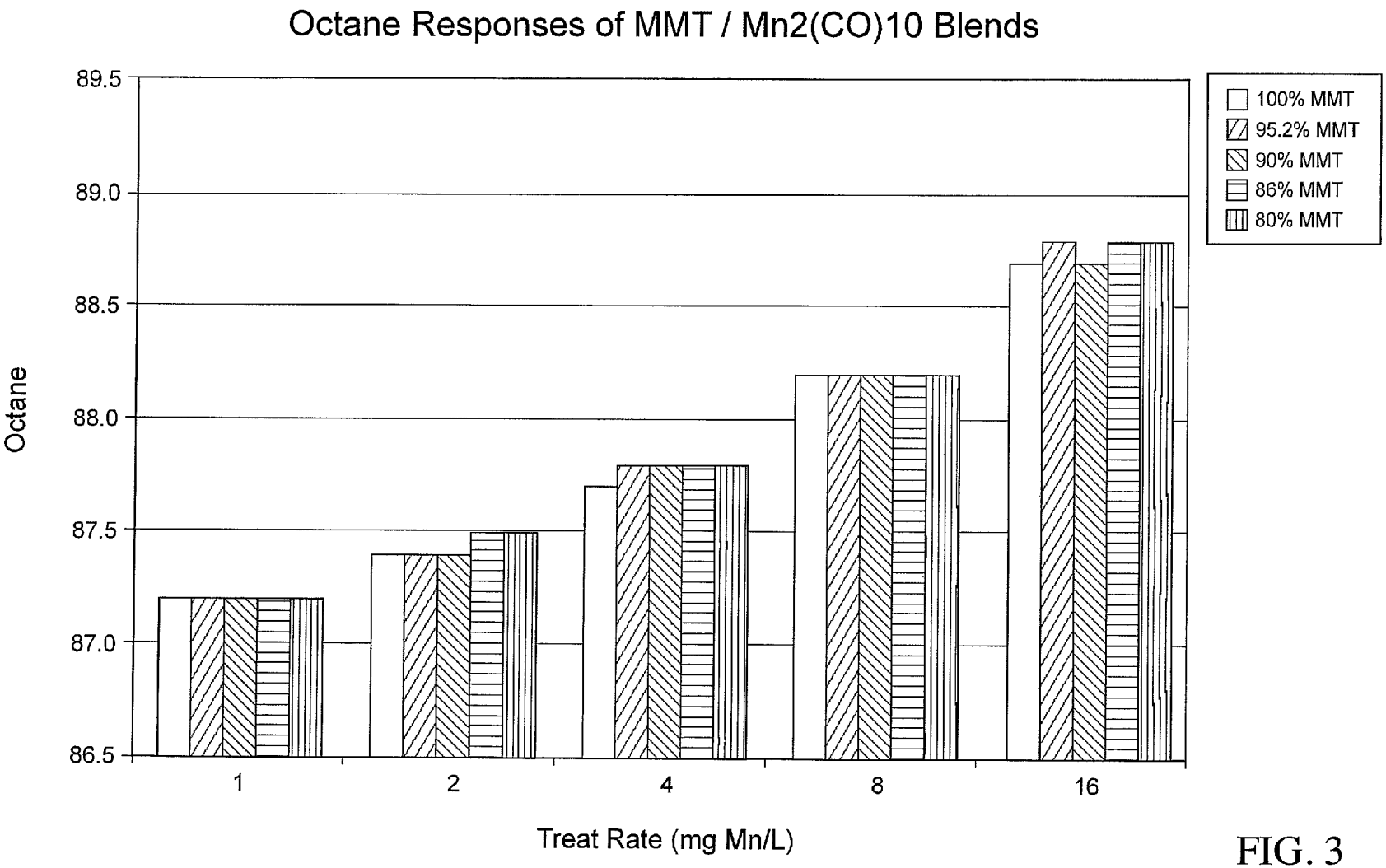
FIG. 3 is a graph illustrating the octane response on compositions comprising methylcyclopentadienyl manganese tricarbonyl and $Mn_2(CO)_{10}$.
Figure 4:
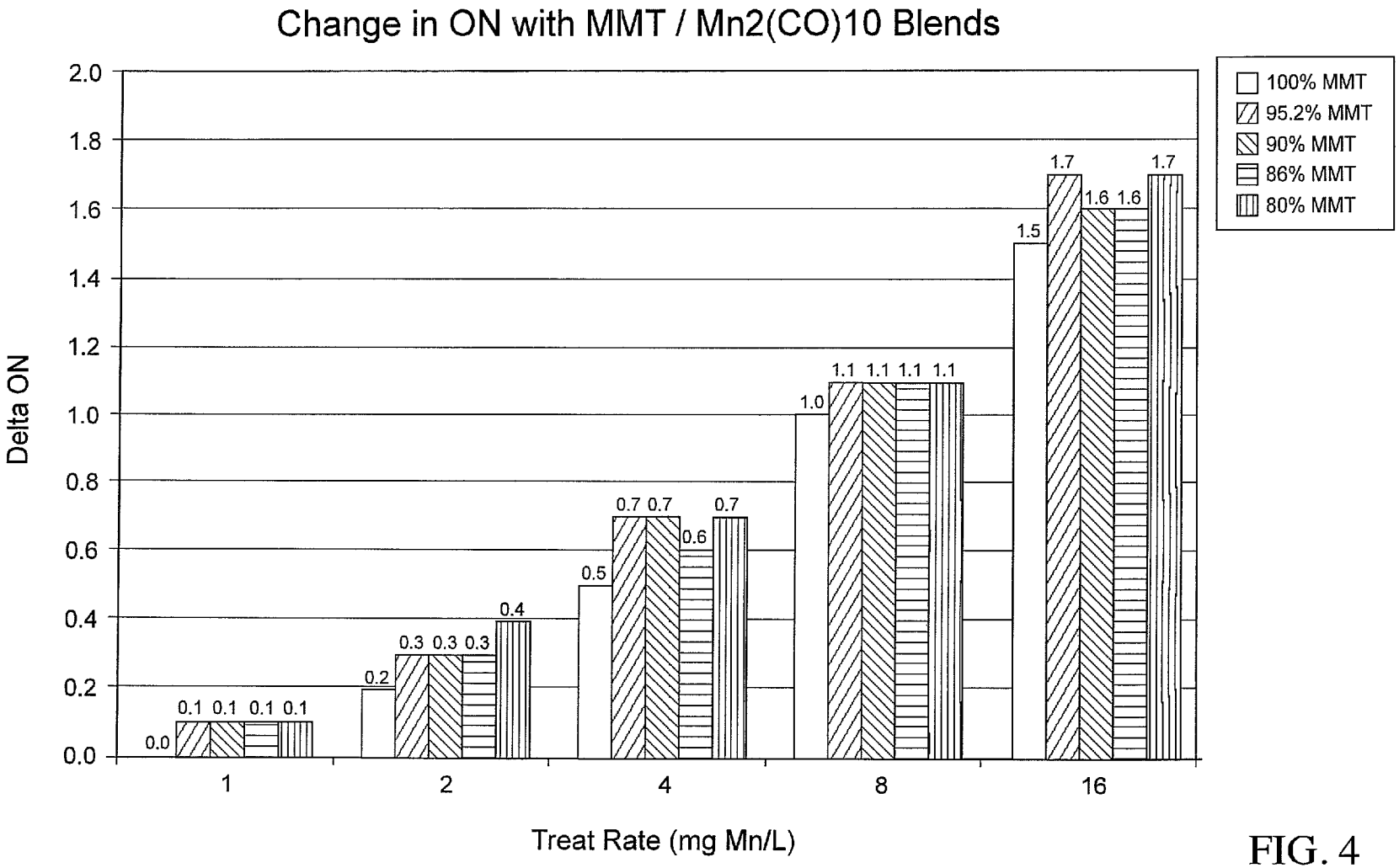
FIG. 4 is a graph illustrating the change in oxidation number response curves on compositions comprising various blends of methylcyclopentadienyl manganese tricarbonyl and $Mn_2(CO)_{10}$.

With regard to FIGS. 3 and 4, equivalent blends with $Mn_2(CO)_{10}$ instead of CMT did not exhibit similar octane synergism as the blends shown in FIGS. 1 and 2. This indicated that octane synergism is only exhibited by organometallic binary, or more compositions, and not organometallic and inorganic compositions, such as MMT/$Mn_2(CO)_{10}$.

Figure 5:
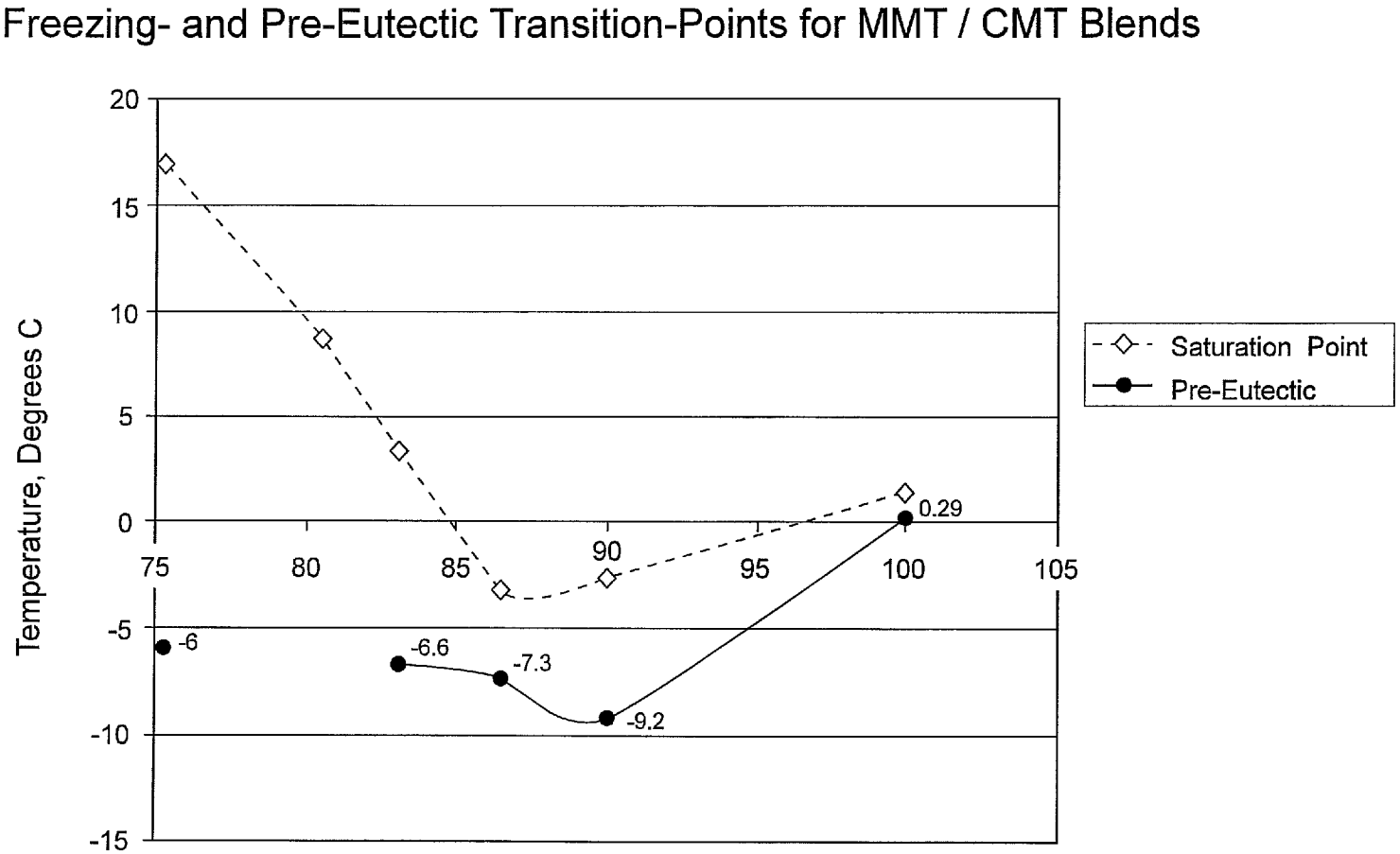
FIG. 5 is a graph illustrating the freezing and pre-eutectic transition points for compositions comprising various blends of methylcyclopentadienyl manganese tricarbonyl and cyclopentadienyl manganese tricarbonyl.

With regard to FIG. 5, the neat MMT/CMT blends were subjected to cooling and warming cycles to determine both freezing points and pre-eutectic transition point temperatures. Such measurements may be carried out in a DSC instrument equipped with high precision cooling, heating and temperature measurement capabilities. It was found that CMT imparted a freezing point depression or suppression with a minimum of −3.9° C. at 13.2 wt % CMT in MMT. In an aspect, the maximum amount of CMT that was added to MMT without changing the freezing point of MMT (1.45° C.) was found to be 15.8 wt %. A benefit from this freezing point depression is an ability to better control the shipping conditions and reduce the costs associated with thawing MMT in cold environments. The eutectic transition point of the MMT/CMT blend, roughly tracked the octane synergism measured. However, the pre-eutectic transition point temperature minimum more accurately predicted the MMT/CMT ratio with optimum octane response at around 10 wt % CMT in MMT.

At numerous places throughout this specification, reference has been made to a number of U.S. patents, published foreign patent applications and published technical papers. All such cited documents are expressly incorporated in full into this disclosure as if fully set forth herein.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Applicant does not intend to dedicate any disclosed embodiments to the public, and to the extent any disclosed modifications or alterations may not literally fall within the scope of the claims, they are considered to be part of the invention under the doctrine of equivalents.

What is claimed is:

1. A method for combusting an organometallic compound in an automotive engine comprising;

(a) providing a fuel composition made by introducing into a fuel a synergistic combination of ingredients comprising a secondary organometallic compound and methylcyclopentadienyl manganese tricarbonyl ("MMT"), the fuel composition having a manganese treat rate ranging from about 2 mg Mn/L of fuel to about 16 mg Mn/L of fuel; and (b) causing the fuel from (a) to be combusted in the engine, wherein the secondary organometallic compound and methylcyclopentadienyl manganese tricarbonyl are combined at a weight ratio of secondary organometallic compound to MMT ranging from about 5:95 to about 15:85 if the manganese treat rate ranges from about 2 mg Mn/L of fuel to 8 mg Mn/L of fuel, and further wherein the secondary organometallic compound and methylcyclopentadienyl manganese tricarbonyl are combined at a weight ratio of secondary organometallic compound to MMT ranging from about 5:95 to about 10:90 if the manganese treat rate ranges from greater than 8 mg Mn/L of fuel to about 16 mg Mn/L of fuel;

wherein the fuel is selected from the group consisting of kerosene, low sulfur motor fuels, synthetic fuels, Fischer-Tropsch fuels, biomass to liquids (BTL) fuels, coal to liquids (CTL) fuels, gas to liquids (GTL) fuels, liquid petroleum gas, fuels derived from coal, genetically engineered biofuels, natural gas, propane, butane, unleaded motor gasolines, and reformulated gasolines, wherein the secondary organometallic compound is cyclopentadienyl manganese tricarbonyl.

2. A method of optimizing octane performance in a fuel composition comprising blending with a hydrocarbon fuel a synergistic mixture comprising methylcyclopentadienyl manganese tricarbonyl ("MMT") and a secondary organometallic compound, the fuel composition having a manganese treat rate ranging from about 2 mg Mn/L of fuel to about 16 mg Mn/L of fuel; wherein the fuel is selected from the group consisting of kerosene, low sulfur motor fuels, synthetic fuels, Fischer-Tropsch fuels, biomass to liquids (BTL) fuels, coal to liquids (CTL) fuels, gas to liquids (GTL) fuels, liquid petroleum gas, fuels derived from coal, genetically engineered biofuels, natural gas, propane, butane, unleaded motor gasolines, and reformulated gasolines, and further wherein the secondary organometallic compound and methylcyclopentadienyl manganese tricarbonyl are combined at a weight ratio of secondary organometallic compound to MMT ranging from about 5:95 to about 15:85 if the manganese treat rate ranges from about 2 mg Mn/L of fuel to 8 mg Mn/L of fuel, and the secondary organometallic compound and methylcyclopentadienyl manganese tricarbonyl are combined at a weight ratio of secondary organometallic compound to MMT ranging from about 5:95 to about 10:90 if the manganese treat rate ranges from greater than 8 mg Mn/L of fuel to about 16 mg Mn/L of fuel, wherein the secondary organometallic compound is cyclopentadienyl manganese tricarbonyl.

3. The method of claim 2, wherein the engine is chosen from a compression ignition engine with and without catalyzed exhaust after treatment systems with OBD monitoring.

4. A method for enhancing octane number of gasoline comprising (a) providing cyclopentadienyl manganese tricarbonyl ("CMT") and methylcyclopentadienyl manganese tricarbonyl ("MMT"), and (b) adding the cyclopentadienyl manganese tricarbonyl and methylcyclopentadienyl manganese tricarbonyl to the gasoline at a manganese treat rate ranging from about 2 mg Mn/L of fuel to about 16 mg Mn/L of fuel, wherein the cyclopentadienyl manganese tricarbonyl and methylcyclopentadienyl manganese tricarbonyl are combined at a weight ratio of CMT to MMT ranging from about 5:95 to about 15:85 if the manganese treat rate ranges from about 2 mg Mn/L of fuel to 8 mg Mn/L of fuel, and further wherein the cyclopentadienyl manganese tricarbonyl and methylcyclopentadienyl manganese tricarbonyl are combined at a weight ratio of CMT to MMT ranging from about 5:95 to about 10:90 if the manganese treat rate ranges from greater than 8 mg Mn/L of fuel to about 16 mg Mn/L of fuel, and wherein the gasoline is selected from the group consisting of Fischer-Tropsch fuels, biomass to liquids (BTL) fuels, coal to liquids (CTL) fuels, gas to liquids (GTL) fuels, liquid petroleum gas, fuels derived from coal, genetically engineered biofuels, unleaded motor gasolines, and reformulated gasolines.

5. The method of claim 2, wherein the engine is chosen from a spark ignition engine, and an advanced spark ignition engine with and without catalyzed exhaust after treatment systems with OBD monitoring.

6. A method for solubilizing cyclopentadienyl manganese tricarbonyl ("CMT") in a hydrocarbonaceous fuel, said method comprising combining in any order cyclopentadienyl manganese tricarbonyl, methyl cyclopentadienyl manganese tricarbonyl ("MMT"), and a hydrocarbonaceous fuel at a manganese treat rate ranging from about 2 mg Mn/L of fuel to about 16 mg Mn/L of fuel, the fuel being selected from the group consisting of kerosene, low sulfur motor fuels, synthetic fuels, Fischer-Tropsch fuels, biomass to liquids (BTL) fuels, coal to liquids (CTL) fuels, gas to liquids (GTL) fuels, liquid petroleum gas, fuels derived from coal, genetically engineered biofuels, natural gas, propane, butane, unleaded motor gasolines, and reformulated gasolines, wherein the cyclopentadienyl manganese tricarbonyl and methylcyclopentadienyl manganese tricarbonyl are combined at a weight ratio of CMT to MMT ranging from about 5:95 to about 15:85 if the manganese treat rate ranges from about 2 mg Mn/L of fuel to 8 mg Mn/L of fuel, and further wherein the cyclopentadienyl manganese tricarbonyl and methylcyclopentadienyl manganese tricarbonyl are combined at a weight ratio of CMT to MMT ranging from about 5:95 to about 10:90 if the manganese treat rate ranges from greater than 8 mg Mn/L of fuel to about 16 mg Mn/L of fuel, and wherein the hydrocarbonaceous fuel does not comprise diesel or aviation fuel.

7. The method of claim 6, wherein the cyclopentadienyl manganese tricarbonyl is added to the methyl cyclopentadienyl manganese tricarbonyl.

8. The method of claim 6, wherein the methylcyclopentadienyl manganese tricarbonyl is added to the cyclopentadienyl manganese tricarbonyl.

9. A method for combusting an organometallic compound in a combustion system comprising;

(a) providing a fuel mixture made by introducing into a fuel a synergistic combination of ingredients comprising a secondary organometallic compound and methylcyclopentadienyl manganese tricarbonyl ("MMT"), the fuel mixture having a manganese treat rate ranging from about 2 mg Mn/L of fuel to about 16 mg Mn/L of fuel; and (b) causing the fuel from (a) to be combusted in the combustion system;

wherein the combustion system is chosen from utility and industrial burners, boilers, furnaces, and incinerators, wherein the secondary organometallic compound and methylcyclopentadienyl manganese tricarbonyl are combined at a weight ratio of secondary organometallic compound to MMT ranging from about 5:95 to about 15:85 if the manganese treat rate ranges from about 2 mg Mn/L of fuel to 8 mg Mn/L of fuel, and further wherein the secondary organometallic compound and methylcyclopentadienyl manganese tricarbonyl are combined at a weight ratio of secondary organometallic compound to MMT ranging from about 5:95 to about 10:90 if the manganese treat rate ranges from greater than 8 mg Mn/L of fuel to about 16 mg Mn/L of fuel, and wherein the fuel is selected from the group consisting of kerosene, low sulfur motor fuels, synthetic fuels, Fischer-Tropsch fuels, biomass to liquids (BTL) fuels, coal to liquids (CTL) fuels, gas to liquids (GTL) fuels, liquid petroleum gas, fuels derived from coal, genetically engineered biofuels, natural gas, propane, butane, unleaded motor gasolines, and reformulated gasolines, wherein the secondary organometallic compound is cyclopentadienyl manganese tricarbonyl.

10. The method of claim 1, wherein the cyclopentadienyl manganese tricarbonyl and methylcyclopentadienyl manganese tricarbonyl are combined in a weight ratio of about 10:90, and further wherein the manganese treat rate ranges from about 4 mg Mn/L of fuel to about 16 mg Mn/L of fuel.

11. The method of claim 4, wherein the cyclopentadienyl manganese tricarbonyl and methylcyclopentadienyl manganese tricarbonyl are combined in a weight ratio of about 10:90, and further wherein the manganese treat rate ranges from about 4 mg Mn/L of fuel to about 16 mg Mn/L of fuel.

12. The method of claim 2, wherein the cyclopentadienyl manganese tricarbonyl and methylcyclopentadienyl manganese tricarbonyl are combined in a weight ratio of about 10:90, and further wherein the manganese treat rate ranges from about 4 mg Mn/L of fuel to about 16 mg Mn/L of fuel.

13. The method of claim 6, wherein the cyclopentadienyl manganese tricarbonyl and methylcyclopentadienyl manganese tricarbonyl are combined in a weight ratio of about 10:90, and further wherein the manganese treat rate ranges from about 4 mg Mn/L of fuel to about 16 mg Mn/L of fuel.

14. The method of claim 9, wherein the cyclopentadienyl manganese tricarbonyl and methylcyclopentadienyl manganese tricarbonyl are combined in a weight ratio of about 10:90, and further wherein the manganese treat rate ranges from about 4 mg Mn/L of fuel to about 16 mg Mn/L of fuel.

* * * * *